US008359748B2

(12) United States Patent
Xu et al.

(10) Patent No.: US 8,359,748 B2
(45) Date of Patent: Jan. 29, 2013

(54) METHOD OF FORMING MICROMACHINED FLUID EJECTORS USING PIEZOELECTRIC ACTUATION

(75) Inventors: Baomin Xu, Cupertino, CA (US); Steven A. Buhler, Sunnyvale, CA (US); Stephen D. White, Santa Clara, CA (US); Scott Jong Ho Limb, Palo Alto, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1106 days.

(21) Appl. No.: 12/273,573

(22) Filed: Nov. 19, 2008

(65) Prior Publication Data

US 2009/0070975 A1 Mar. 19, 2009

Related U.S. Application Data

(62) Division of application No. 11/312,305, filed on Dec. 20, 2005, now Pat. No. 7,467,857.

(51) Int. Cl.
*B21D 53/76* (2006.01)
*H04R 17/00* (2006.01)

(52) U.S. Cl. ..... 29/890.1; 29/25.35; 216/39

(58) Field of Classification Search ..... 29/25.35, 29/890.1, 830; 347/63, 64, 68, 71; 216/39, 216/54

See application file for complete search history.

(56) References Cited

U.S. PATENT DOCUMENTS

| | | | | |
|---|---|---|---|---|
| 5,265,315 | A | 11/1993 | Hoisington et al. | |
| 5,446,484 | A | 8/1995 | Hoisington et al. | |
| 6,103,072 | A | 8/2000 | Nishiwaki et al. | |
| 6,290,331 | B1 | 9/2001 | Agarwal et al. | |
| 6,705,708 | B2 | 3/2004 | Murai | |
| 6,824,257 | B2 | 11/2004 | Silverbrook | |
| 6,895,645 | B2 | 5/2005 | Xu et al. | |
| 6,964,201 | B2 | 11/2005 | Xu et al. | |
| 7,036,913 | B2 * | 5/2006 | Kim et al. | 347/63 X |
| 7,089,635 | B2 | 8/2006 | Xu et al. | |
| 7,290,867 | B2 | 11/2007 | Kobayashi et al. | |
| 2004/0179064 | A1 | 9/2004 | Zapka et al. | |
| 2009/0073242 | A1 | 3/2009 | Xu et al. | |

FOREIGN PATENT DOCUMENTS

| | | | | |
|---|---|---|---|---|
| JP | 04185348 A * | 7/1992 | | 347/71 |
| WO | WO0121172 A1 | 1/2001 | | |

* cited by examiner

*Primary Examiner* — A. Dexter Tugbang
(74) *Attorney, Agent, or Firm* — Fay Sharpe LLP

(57) ABSTRACT

A method of forming a fluid ejector includes forming a recess well into a silicon wafer on a first side of the silicon wafer, and filling the recess well with a sacrificial material. A thin layer structure is deposited onto the first side of a silicon wafer covering the filled recess well. Then a thin film piezoelectric is bonded or deposited to the thin layer structure, and a hole is formed in the thin layer structure exposing at least a portion of the sacrificial material. The sacrificial material is removed from the recess well, wherein the hole in the thin layer in the recess well with the sacrificial material removed, form a fluid inlet. An opening area in the silicon wafer is formed on a second side of the silicon wafer. Then a nozzle plate is formed having a recess portion and an aperture within the recess portion. The nozzle plate is attached to the second side of the silicon wafer, with the recess portion positioned within the open area. The thin layer structure and the recess portion of the nozzle plate define a depth of a fluid cavity defined by the thin layer structure, the recess portion of the nozzle plate and the sidewalls of the silicon wafer.

20 Claims, 16 Drawing Sheets

METHOD OF FORMING MICROMACHINED FLUID EJECTORS USING PIEZOELECTRIC ACTUATION

CROSS REFERENCE TO RELATED PATENTS AND APPLICATIONS

This is a divisional of application of U.S. Ser. No. 11/312,305, filed Dec. 20, 2005, entitled "Micromachined Fluid Ejectors Using Piezoelectric Actuation", by Baomin Xu et al., the disclosure of which is hereby incorporated by reference in its entirety. The disclosure of co-pending application, Ser. No. 12/273,573, entitled "Multi-Layer Monolithic Fluid Ejectors Using Piezoelectric Actuation", by Baomin Xu et al., filed Nov. 18, 2008, is also hereby incorporated by reference in its entirety.

BACKGROUND

The present application is directed to fluid ejectors, and more particularly, to fluid ejectors using piezoelectric actuation, and methods to make the same. Micromachined fluid ejectors, such as ink jet printheads, using either electrostatic or piezoelectric actuation have been discussed. When electrostatic actuation is employed, the fluid ejectors are fabricated using standard silicon micromachining processes. Because the energy density of electrostatic actuators is very small, the required driving voltage is quite high (e.g., commonly 50V or more). Use of electrostatic actuation also makes the ejectors vulnerable to damage caused by the snap-down operation of the active diaphragm.

Fluid ejectors employing piezoelectric actuators have also been considered. Several advantages exist in the use of piezoelectric actuation, including lower driving voltages and elimination of device failure occurring due to snap-down of an active diaphragm. Bulk piezoelectric actuation systems commonly require larger driving voltages than ejectors which employ piezoelectric thin films since, for example, the distance between the electrodes is larger in the bulk piezoelectric actuators. In either case, either type of piezoelectric actuator based fluid ejector requires lower driving voltages than electrostatic based ejectors. While lower driving voltages are expected for thin film piezoelectric actuators, there are several challenges in making operable piezoelectric thin film based fluid ejectors, especially for micromachined fluid ejectors. Particularly, sufficient energy must be developed by the piezoelectric material, and that energy must be effectively transferred to the fluid for consistent controllable drop ejection.

BRIEF DESCRIPTION

A method of forming a fluid ejector includes forming a recess well into a silicon wafer on a first side of the silicon wafer, and filling the recess well with a sacrificial material. A thin layer structure is deposited onto the first side of a silicon wafer covering the filled recess well. Then a thin film piezoelectric is bonded or deposited to the thin layer structure, and a hole is formed in the thin layer structure exposing at least a portion of the sacrificial material. The sacrificial material is removed from the recess well, wherein the hole in the thin layer in the recess well with the sacrificial material removed, form a fluid inlet. An opening area in the silicon wafer is formed on a second side of the silicon wafer. Then a nozzle plate is formed having a recess portion and an aperture within the recess portion. The nozzle plate is attached to the second side of the silicon wafer, with the recess portion positioned within the open area. The thin layer structure and the recess portion of the nozzle plate define a depth of a fluid cavity defined by the thin layer structure, the recess portion of the nozzle plate and the sidewalls of the silicon wafer.

DETAILED DESCRIPTION

The following description sets forth improved design and manufacturing processes of micromachined, fluid ejectors such as piezoelectric actuated fluid ejectors. While fluid ejectors employing thin film piezoelectric actuation will theoretically require lower driving voltages than other actuation arrangements, several challenges exist to the manufacture of actual usable thin film piezoelectric actuation based fluid ejectors. Initially, when thin film piezoelectric actuators are used, it has been determined by the inventors that they have to have a sufficiently small sized fluid cavity to mechanically match the impedance between the actuator and the fluid being ejected. This makes it difficult to directly use a conventional silicon wafer to build the fluid cavity since the thickness of the conventional silicon wafer is too large, usually between 300 μm to 500 μm thick. Thus, constructing an efficient fluid structure becomes very complicated. Further, the compatibility of depositing piezoelectric thin films with integrated CMOS silicon microelectronics is an issue, as the process for depositing the piezoelectric thin film will tend to destroy the integrated CMOS circuit on the silicon substrate. The present application makes it possible to use conventionally sized silicon wafers in the construction of fluid ejectors, without the need of more polishing, grinding or otherwise making the entire silicon wafer thinner than the conventional thickness.

In a first approach a recess structure formed in the nozzle plate is employed. Thus when the nozzle plate is bonded to the silicon wafer substrate, the formed recessed portion part fits into an open area in the body of the silicon wafer substrate, selectively reducing the volume of the fluid cavity formed on the substrate. In a second approach, a multi-layer structure including a diaphragm thin film piezoelectric and reduced fluid cavity is fabricated onto one side of the silicon wafer substrate. These two approaches allow the fluid cavity to be small enough to achieve mechanical impedance matching between the fluid cavity and the thin film piezoelectric actuator which is less than approximately 10 μm thick. This impedance matching allows for the use of driving voltages as low as a few volts (e.g., 4 volts). In addition, a laser liftoff transfer method is used to transfer the thin film piezoelectric from a fabrication substrate (e.g., sapphire) to a silicon substrate having integrated driving electronics. Use of the laser liftoff procedure avoids contamination and damage problems due to the piezoelectric deposition procedures.

Figure 1:
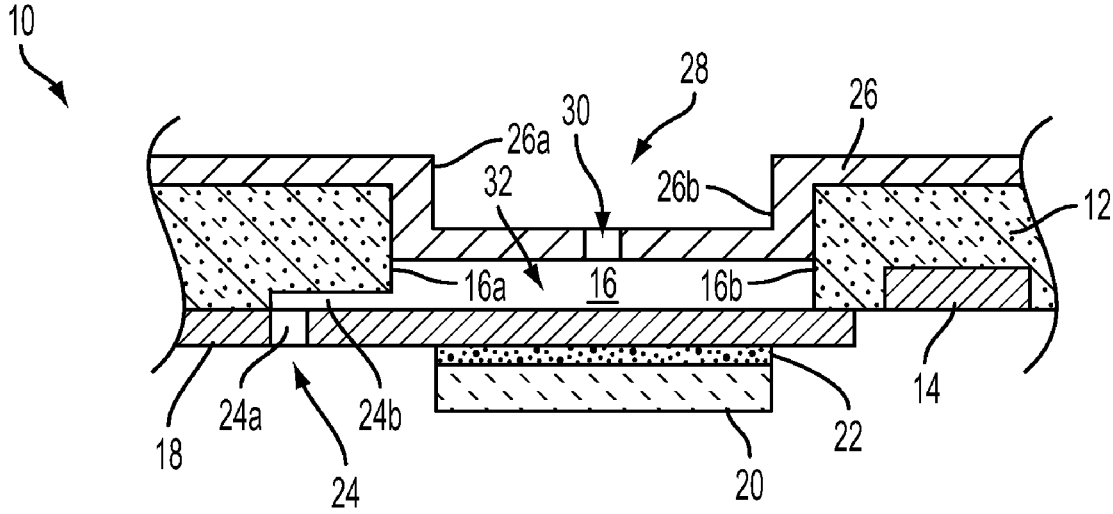
FIG. 1 illustrates a schematic of a micromachined fluid ejector in accordance with the present application.

Turning to FIG. 1, illustrated is a fluid ejector 10, including a bulk silicon wafer 12 which has integrated drive electronics 14, and which is micromachined to form an open area 16 with sidewalls 16*a*, 16*b*. Deposited on a surface of silicon wafer 12 is a thin structure layer (or membrane) 18, preferably with a thickness of a few micrometers (e.g., 1 μm to 10 μm, and more preferably 1 μm to 3 μm thick). Thin structure layer 18 can be a silicon based material such as polysilicon, silicon nitride or oxide, a metal or other appropriate material. In one embodiment thin structure layer 18 is a patterned metal layer, which is also used as a bottom electric connection for the piezoelectric thin film layer 20, which is preferably 1 μm to 10 μm thick, and more preferably 1 μm to 5 μm thick. In another embodiment thin structure layer 18 is a patterned silicon nitride or oxide, and on which is a very thin metal layer (not shown in the figure) deposited and patterned to connect the piezoelectric actuator to the drive electronics 14, as is well known in the art. Piezoelectric layer 20 is bonded to thin structure layer 18 via bonding layer 22, and forms a bending mode diaphragm actuator for pushing fluid. A fluid channel 24 is formed by micromachined or laser drilled opening 24*a* and micromachined channel 24*b*. Additional fluid channels may be formed as needed.

A separately fabricated nozzle plate 26 having vertical walls 26*a*, 26*b*, a recessed nozzle structure 28, and an aperture 30, is bonded and sealed to a second side of silicon wafer 12. Silicon sidewalls 16*a*, 16*b*, thin structure layer 18 and recessed portion 28 of nozzle plate 26 define a reduced volume fluid cavity 32 within the silicon wafer 12. The recessed portion 28 of nozzle plate 26 is fitted into open area 16 of silicon wafer 12 to form a top portion of fluid cavity 32. The depth of recess 28 acts to define the height (or depth) of fluid cavity 32, where the height (or depth) of fluid cavity 32 is less than the thickness of silicon wafer 12. In one embodiment, recess 28 is selected so the height (or depth) of fluid cavity 32 is about 200 μm or less. Nozzle plate 26 can be made from metal such as nickel or other appropriate material.

While a single fluid ejector is shown, arrays of fluid ejectors, having the same or similar structure as shown in FIG. 1, can be made on a silicon wafer.

Turning to FIGS. 2*a*-2*i*, 3*a*-3*c* and 4*a*-4*c*, illustrated are the major steps used to make fluid ejector 10 of FIG. 1, including forming the recessed nozzle plate.

Figure 2A:
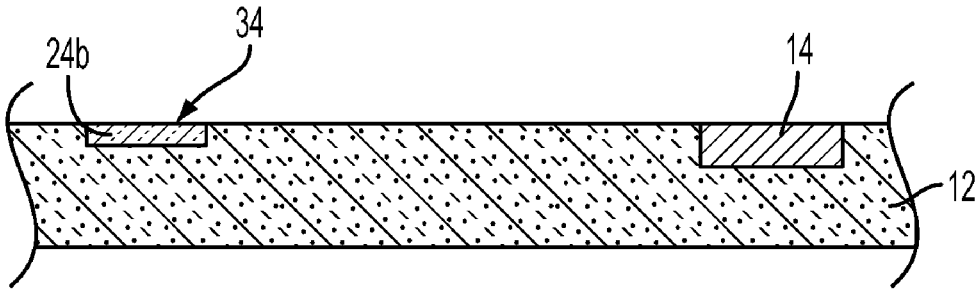
FIGS. 2*a*-2*i* depict a process flow for manufacturing the fluid ejector of FIG. 1.

As depicted in FIG. 2*a*, starting with silicon wafer 12, which has integrated drive electronics 14 on a first side of the silicon wafer, a thin and relatively long well or channel 24*b* (which will be part of fluid inlet 24) is etched and then filled with sacrificial material 34, such as PSG glass (phosphosilicate glass) or other etchable or removable material. Several wells will be made if several channels are to be used.

Figure 2B:
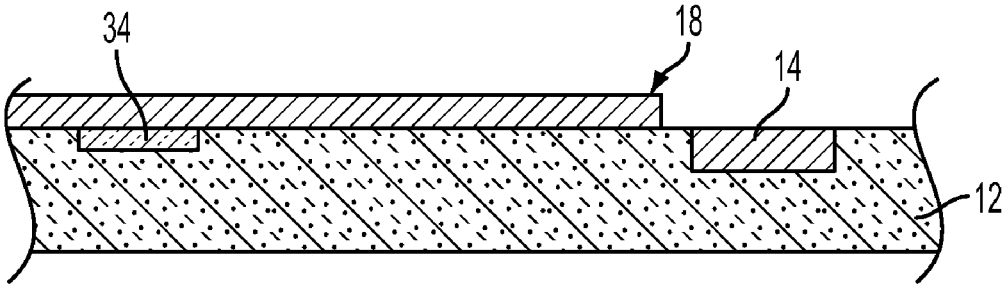

In FIG. 2*b*, thin structure layer 18, preferably with the thickness of a few micrometers (μm), is deposited onto a surface of silicon wafer 12 to cover sacrificial material 34. The material of thin structure layer 18 can be a silicon based material such as polysilicon, silicon nitride or oxide, or other material such as metal, so that selective etching can be undertaken between the bulk silicon wafer 12 and thin structure layer 18. In one embodiment, thin structure layer 18 is deposited as a thin metal layer by use of a shadow mask. This patterned thin metal layer can also then be used as a bottom connection for piezoelectric thin film 20. In another embodiment, thin structure layer 18 is deposited as a thin silicon oxide or nitride which can be patterned using a dry or wet etching method. In this case a very thin metal layer (not shown in the figure) will be deposited on the thin silicon oxide or nitride layer with a shadow mask, or patterned using dry or wet chemical etching methods after deposition. The very thin metal layer is used to connect to the piezoelectric thin film 20.

Figure 2C:
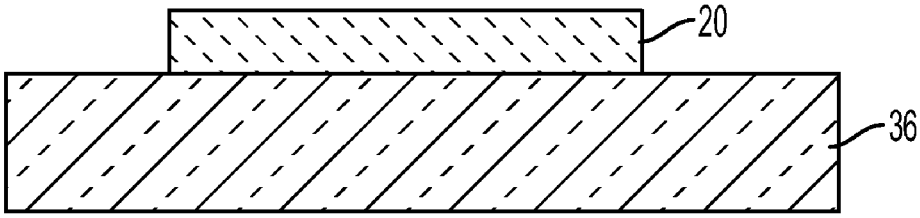

Turning to FIG. 2*c*, piezoelectric thin film 20 is fabricated on a separate transparent substrate 36. This includes but is not limited to depositing piezoelectric thin film 20 on transparent substrate 36, with a transparent electrode such as ITO (Indium-Tin oxide) on a coated sapphire substrate using a deposition method such as sol-gel, depositing a top surface electrode (not shown), patterning the film and electrode, and then poling the piezoelectric thin film 20. In one embodiment, the piezoelectric thin film is PZT (lead zirconate titanate) material made by sol-gel, sputtering, CVD (chemical vapor deposition), PLD (pulsed laser deposition), or other suitable deposition methods.

Figure 2D:
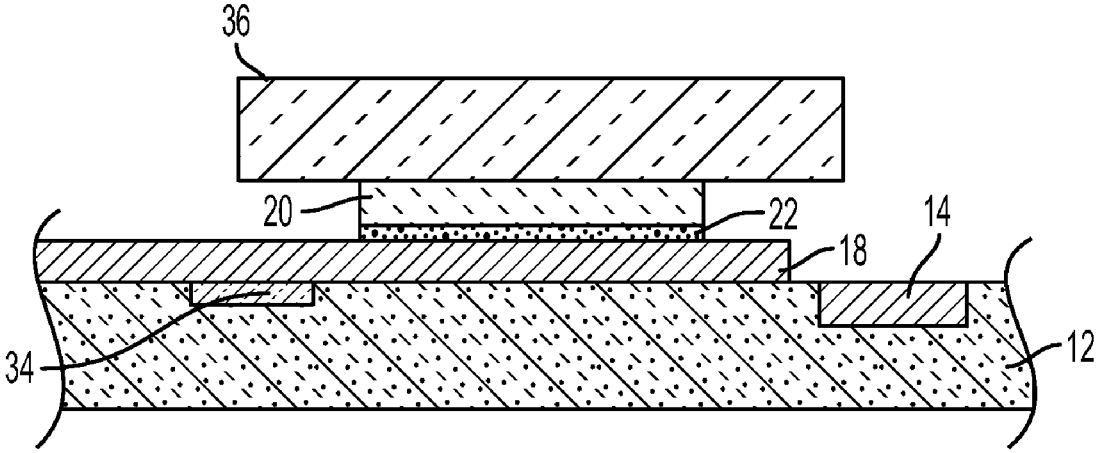

Next, bonding of piezoelectric thin film 20 to thin structure layer 18 via bonding layer 22 is depicted in FIG. 2*d*, using a bonding technique such as but not limited to a thin film metal transient liquid phase bonding.

Figure 2E:
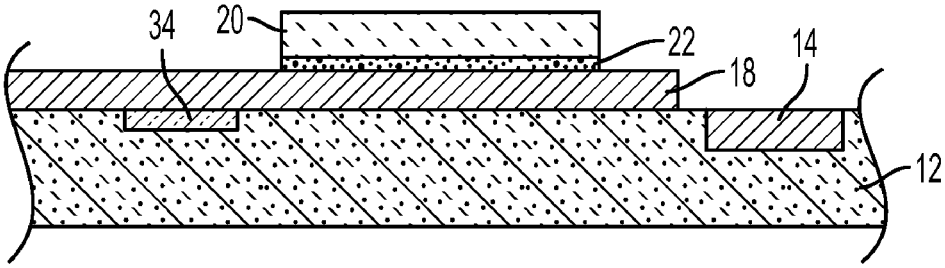

In FIG. 2*e*, transparent (e.g., sapphire) substrate 36 is removed, such as by a laser liftoff process method, and an ion mill operation is used to remove any laser induced surface damage, then an electrode (not shown) is deposited on the piezoelectric surface, and the piezoelectric thin film is connected to the drive electronics 14 by well-known connection techniques (not shown). More details of the formation of the piezoelectric and the laser liftoff procedure are discussed for example as in U.S. Pat. No. 6,964,201, issued Nov. 15, 2005, entitled "Large Dimension, Flexible Piezoelectric Ceramic Tapes," by Baomin Xu et al.; U.S. Pat. No. 6,895,645, issued May 24, 2005, entitled "Methods to Make Bimorph MEMS," by Baomin Xu et al.; and U.S. patent application Ser. No. 10/376,544, filed Feb. 25, 2003, entitled "Methods to Make Piezoelectric Ceramic Thick Film Array and Single Elements and Devices," by Baomin Xu, et al., each hereby incorporated herein by reference in their entirety.

Figure 2F:
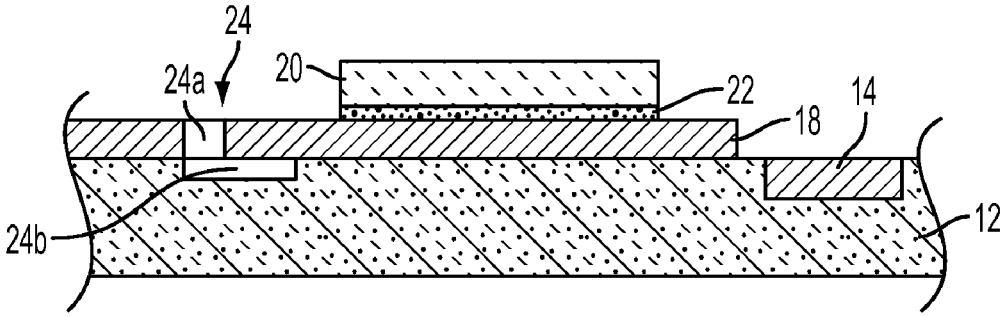
Figure 2G:
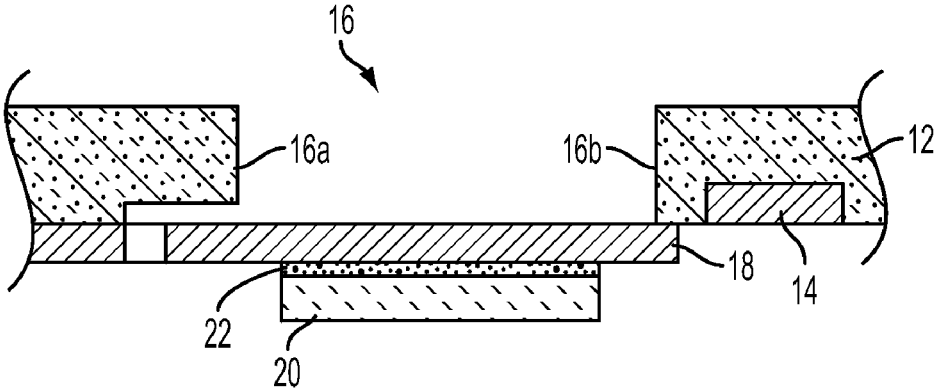

Next, as shown in FIG. 2*f*, hole 24*a* is etched or drilled in the thin structure layer 18. Then, sacrificial material 34 is etched away by use of hole 24*a*, to form ink inlet channel 24. As illustrated in FIG. 2*g* (where the described structure has been rotated top-to-bottom from its presentation in FIG. 2*f*, on the other or second side of silicon wafer 12, micromachining of the silicon wafer is undertaken to selectively remove silicon and form an opening area 16 having sidewalls 16*a*, 16*b*. Fluid cavity 32 is to be defined within open area 16.

Figure 2H:
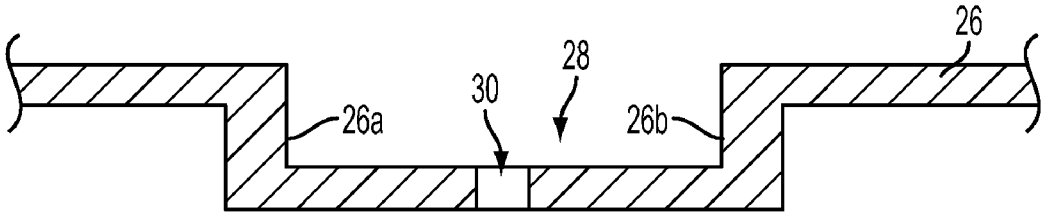

FIG. 2*h* shows nozzle plate 26 produced according to the required structure, i.e., including recessed portion 28 and aperture 30. Details on the manufacture of nozzle plate 26 will be provided in connection with FIGS. 3*a*-3*c* and 4*a*-4*c*.

Figure 2I:
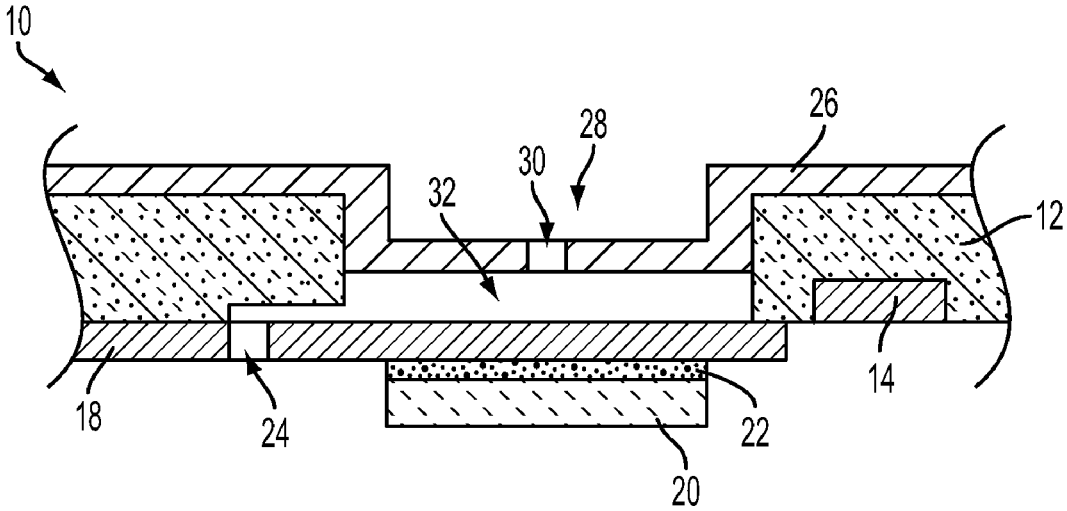

Finally, as depicted in FIG. 2*i*, nozzle plate 26 is bonded to silicon wafer 12 to form fluid ejector 10 with selectably sizable fluid cavity 32. The nozzle plate 26 may be bonded with adhesive or solder which will fill in gaps to avoid air bubbles and seal the ink cavity.

Turning now to FIGS. 3*a*-3*c* and 4*a*-4*c*, two methods to make a nozzle plate in accordance with the present concepts are set forth. The first embodiment uses a mechanical stamping process. The second embodiment uses an electroplating method.

Figure 3A:
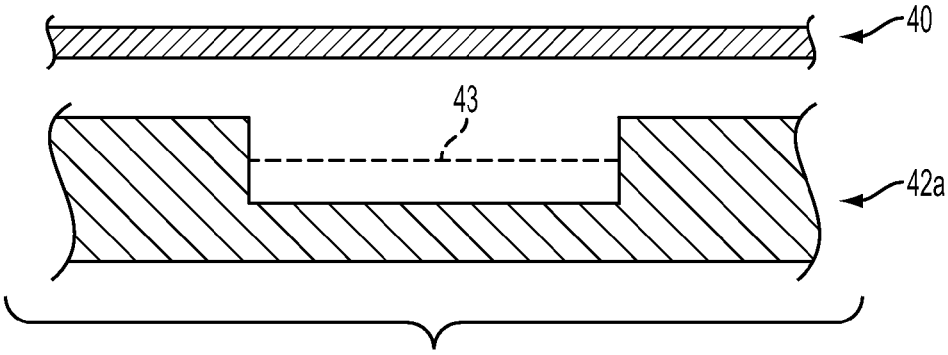
FIGS. 3*a*-3*c* depict a first embodiment for forming a recessed nozzle plate used with the fluid ejector of FIG. 1.

In FIG. 3*a*, the process employs a metal foil 40 and a lower metal mold portion 42*a*, which has an opening with similar dimensions as open area 16 of silicon wafer 12 but with a different depth. Attention is directed to dotted line 43. This dotted line is intended to show an alternative representation of the lower metal mold portion 42*a*. In particular, dotted line 43 is provided to emphasize that nozzle plates, such as nozzle plate 26 of FIG. 1 can have selectively alterable configurations. In this specific example, dotted line 43 emphasizes that the depth of the recessed portion of the nozzle plate, such as recessed portion 28 of FIG. 1, is controllable during the manufacturing process. More particularly, a manufacturer or user of the present concepts would provide a specific depth in the recessed portion such that a high level of impedance matching will exist between the fluid within the fluid cavity and the actuator of a particular fluid ejector device. It is to be understood that dotted line 43 is simply provided as showing the adjustable or selective features of the nozzle plate according to the present application, and other depths and/or configurations of the nozzle plate to improve the mechanical impedance are within the realm of the present application.

Figure 3B:
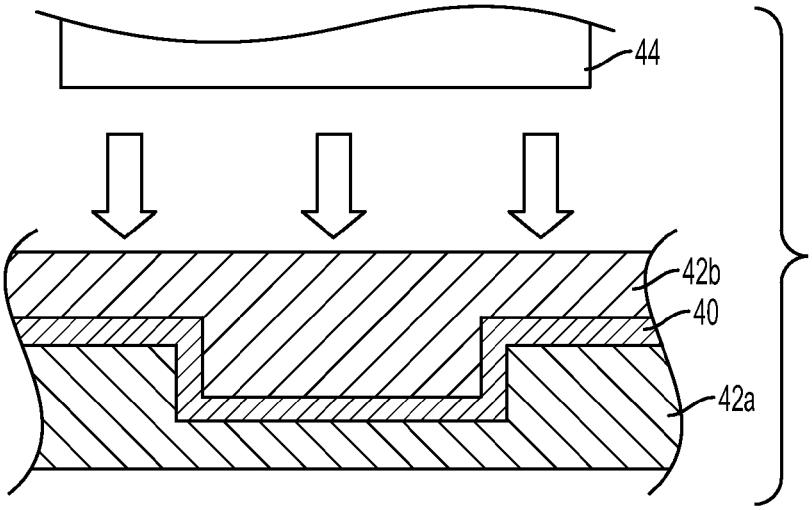

Next, as depicted in FIG. 3*b*, metal foil 40 is pressed into lower mold portion 42*a*, by use of an upper mold stamp portion 42*b*. While maintaining pressure, mold 42 is heated by heater 44 to a temperature sufficient to induce permanent deformation of metal foil 40.

Figure 3C:
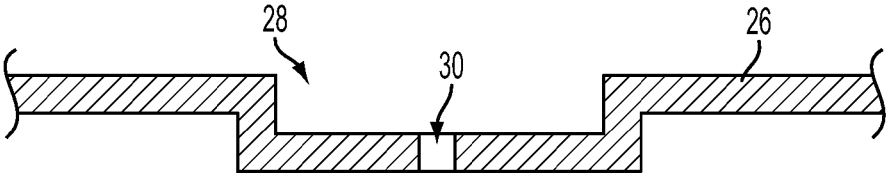

Lastly, in FIG. 3*c* mold portions 42*a*, 42*b* are removed and aperture 30 is etched or laser drilled in deformed metal foil 40, to form nozzle plate 26 with recess 28. Aperture 30 can also be formed by etching or laser drilling before stamping the metal foil 40.

Figure 4A:
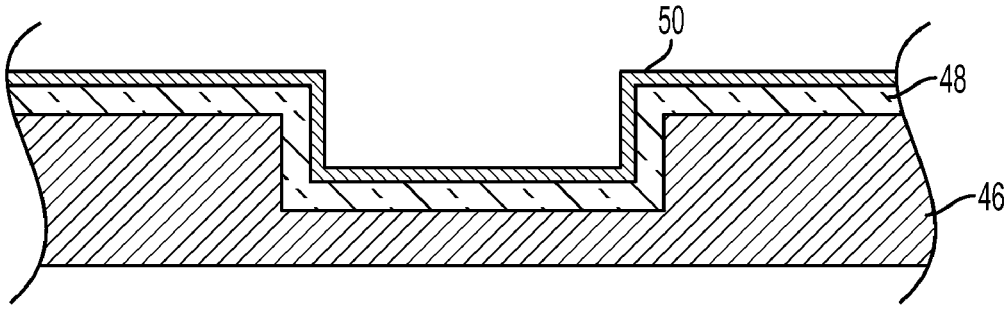
FIGS. 4*a*-4*c* depict a second embodiment for formation of a recessed fluid plate used with the fluid ejector of FIG. 1.

Turning to a second embodiment, in FIG. 4*a*, the process starts with a metal or silicon mold 46. The mold has an opening with similar dimensions as of silicon wafer 12 but a different depth. A sacrificial layer 48, and then a thin metal film 50 are deposited onto mold 46.

Figure 4B:
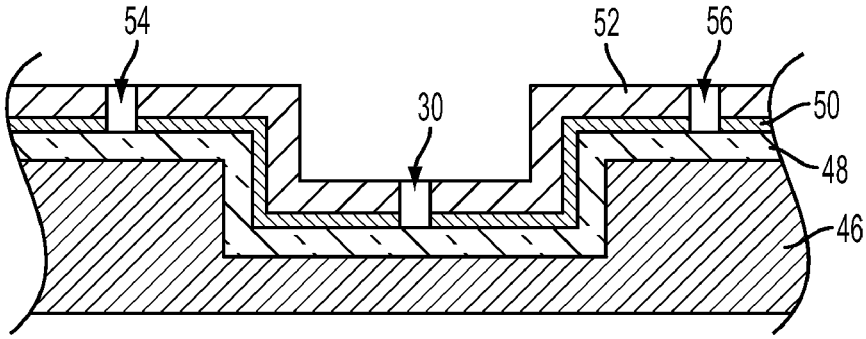

Next, as shown in FIG. 4*b*, a relatively thick metal layer 52 is deposited on thin metal film 50, with a thickness about several micrometers (μm) (e.g, 1 μm to 10 μm) by using a manufacturing procedure such as an electroplating method. This deposited metal layer 52 could be either the same or different metal as the thin metal film 50. Following the deposition, an aperture 30 and holes 54, 56 are laser drilled or etched through layers 52 and 50 to reach sacrificial layer 48. Holes 54, 56 are provided if needed to etch away the sacrificial layer 48. Alternatively, holes 54, 56 might not be provided, and etching of sacrificial layer 48 may be undertaken through aperture 30 alone.

Figure 4C:
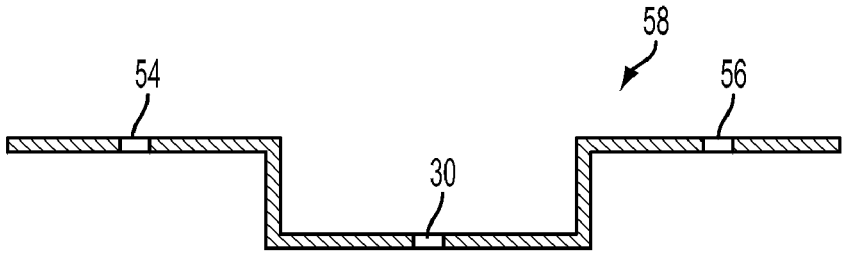

Then, as shown in FIG. 4*c*, sacrificial layer 48 as shown in FIG. 4*a* is etched away, and the metal or silicon mold 46 is removed, providing fabricated nozzle plate 58, which may be used in the fluid ejector of FIG. 1.

Figure 5:
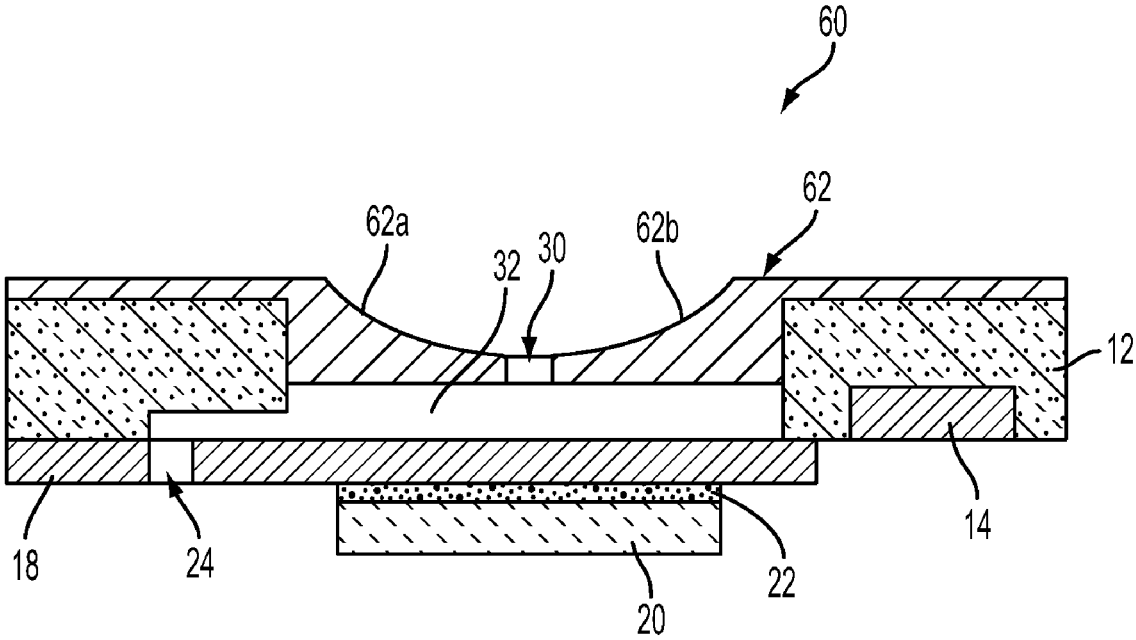
FIG. 5 shows a modified version for a fluid ejector according to the present application.

Turning to FIG. 5, a modified structure of the micromachined fluid ejector of FIG. 1 is depicted. As will be understood from a review of FIG. 5, fluid ejector 60 is constructed substantially similar to ejector 10 of FIG. 1. However, in this design nozzle plate 62 has sloping sidewalls 62*a*, 62*b* as opposed to the substantially vertical sidewalls 26*a*, 26*b* of FIG. 1. By this construction, additional material is provided in the nozzle plate for increased strength of the nozzle plate. A nozzle plate of this design can be configured by use of, for example, an electroplating method.

Figure 6A:
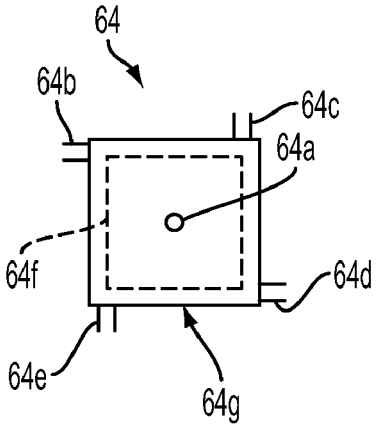
FIGS. 6*a*-6*c* depict top view sketches shown conceptual fluid cavity structures.
Figure 6B:
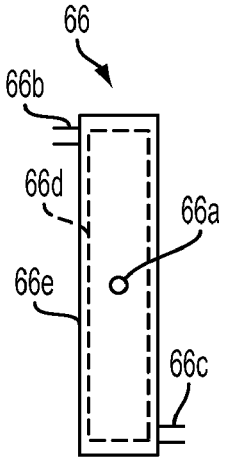
Figure 6C:
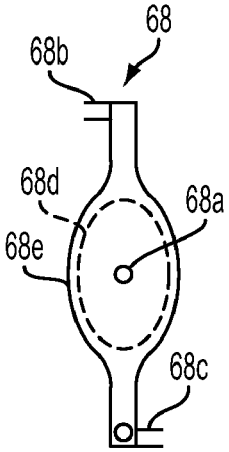

Turning to FIGS. 6*a*-6*c*, top views of alternative fluid cavity shapes are provided. The fluid cavity can be formed as a square shape 64, a thin and long rectangular shape 66, or a curved shape 68, among others. While fluid apertures 64*a*, 66*a*, 68*a* shown in FIGS. 6*a*-6*c* are made close to the center of the nozzle plate, this is not necessary for many applications. Several inlets 64*b*-64*e*, 66*b*-66*c*, and 68*b*-68*c* are shown as being provided to the fluid cavity, which are intended to be placed strategically to help minimize the undesirable generation of air bubbles which may form during the initial fluid filling of the cavities. While four inlets are shown for FIG. 6*a* and two inlets for FIGS. 6*b* and 6*c*, this is not necessary, and different numbers of inlets could be used for different designs or applications. Each of FIGS. 6*a*, 6*b*, 6*c* also show piezoelectric thin films 64*f*, 66*d* and 68*d*, and fluid cavities 64*g*, 66*e*, 68*e*. The curved design of FIG. 6*c* is intended to incorporate features such as inlet impedance within the ink chamber. The curved design can be arranged in a staggered arrangement when an array of fluid ejectors is formed.

It is to be appreciated, the processes for manufacturing the nozzle plates as shown in FIGS. 3*a*-3*c*, and 4*a*-4*c* may include molds and machining processes which result in the manufacture of nozzle plates having profiles similar to the fluid cavity to which it is to be associated. For example, the processes of FIGS. 3*a*-3*c* and 4*a*-4*c* can be modified to form nozzles having square shapes, thin and long rectangular shapes or curved shapes, among others, as for example as discussed in connection with FIGS. 6*a*-6*c*.

Figure 7:
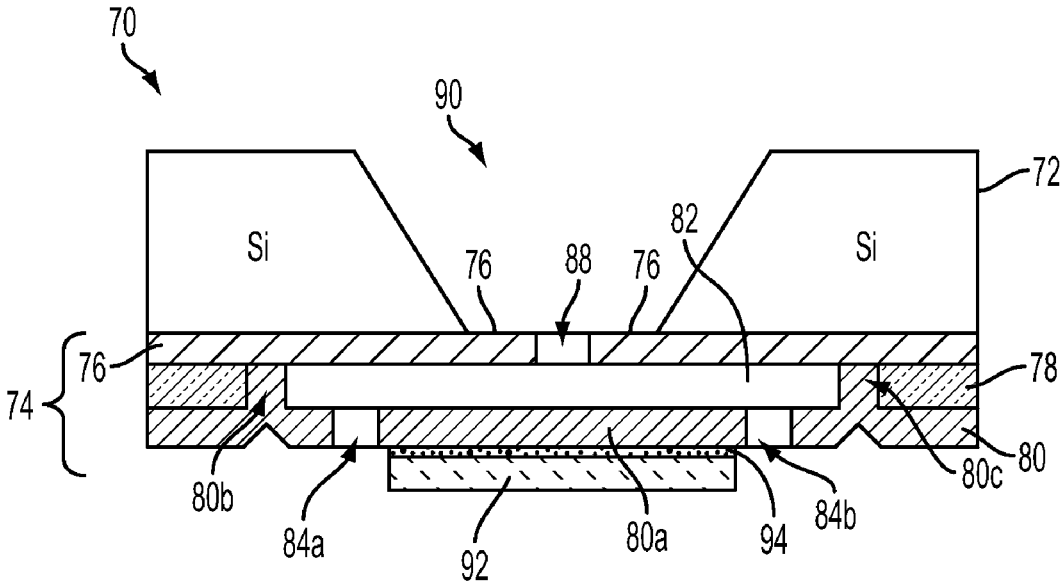
FIG. 7 shows a second embodiment for a structure of a micromachined fluid ejector according to the present application.

Turning to FIG. 7, depicted is a second design for a fluid ejector 70. Instead of using the silicon wafer to form the fluid cavity, a structure with several layers on one side of the silicon wafer is built. The fluid cavity, fluid inlet and ejector aperture are constructed within this multi-layer structure. The height or depth of the ink cavity being preferably controlled to be 200 μm or less, and more preferably in a range of about 100 μm to 200 μm.

With more particular attention to fluid ejector 70 of FIG. 7, in this structure, silicon wafer 72 has a monolithic structure 74 built on one side. The structure includes a first structure layer 76, a sacrificial (e.g., polysilicon) layer 78 sandwiched between the first structure layer 76 and a second structure layer 80. The second structure layer includes a horizontal portion 80*a* and filled trenches or vertical sidewalls 80*b* and 80*c*. The first structure layer 76, horizontal portion 80*a* and filled trenches/vertical sidewalls 80*b* and 80*c* of the second structure layer define a fluid cavity 82. Holes or openings 84*a* and 84*b* are formed within the second structure layer 80 to act as fluid inlets, and aperture 88 is formed in the first structure layer 76 to emit fluid. The silicon wafer 72 has been etched through a second surface to create an open area 90 exposing portions of the first structure layer 76 whereby aperture 88 is open to free space. A piezoelectric thin film 92 is bonded to the horizontal portion of the second structure layer 80 via a bonding layer 94.

Figure 8A:
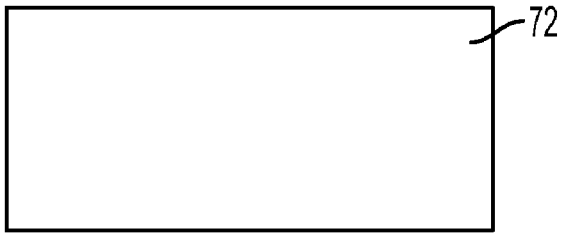
FIGS. 8*a*-8*i* depict a process flow for manufacturing a fluid ejector such as shown in FIG. 7.
Figure 8B:
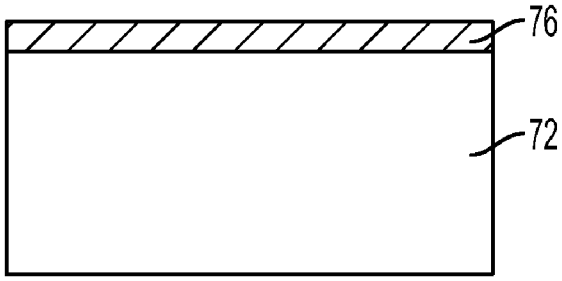

With particular attention to FIG. 8*a*, the process for fabricating a fluid ejector as shown in FIG. 7 begins with obtaining a silicon substrate 72, and then as shown in FIG. 8*b*, depositing a first structure layer 76 thereto, where structure layer 76 may be a metal conductive layer, or silicon oxide or nitride layer deposited by any of known depositing methods, such as CVD, PVD, electroplating or other depositing procedure.

Figure 8C:
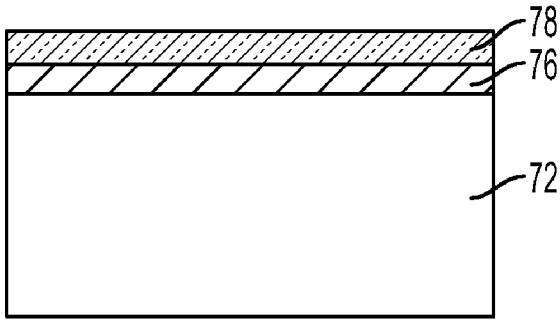

Next, as shown in FIG. 8*c*, a sacrificial layer 78 is deposited on top of the first structure layer 76. Sacrificial layer 78 can be a polysilicon or other material having characteristics which permit its selective etching or otherwise removal during the formation of the fluid ejector. The depth or height of sacrificial layer 78 is particularly controlled, as it will define the height of the fluid cavity.

Figure 8D:
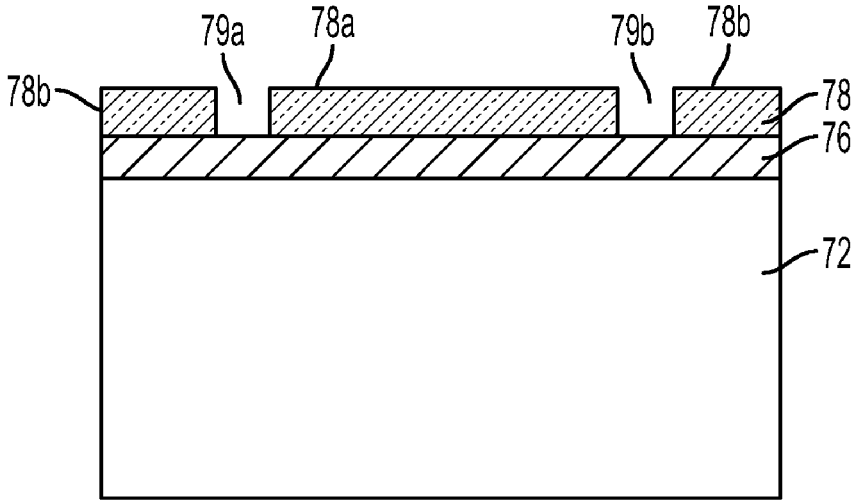
Figure 8E:
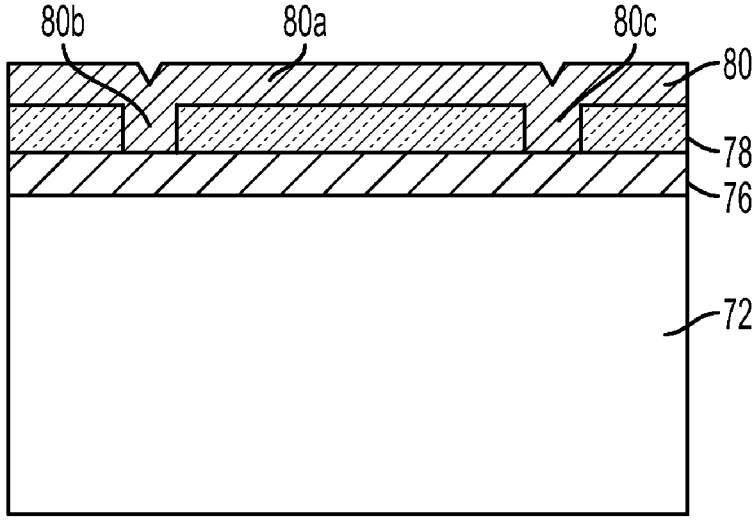
Figure 8F:
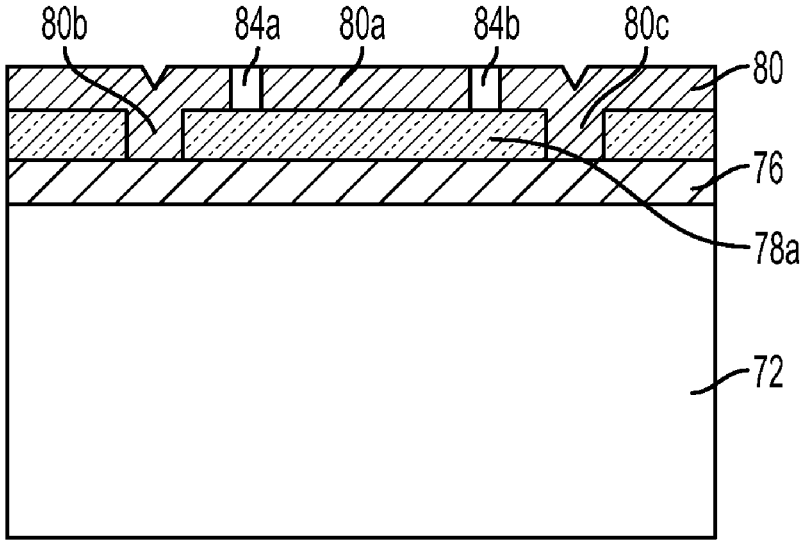

In FIG. 8*d*, portions of sacrificial layer 78 are etched or otherwise removed to form closed trenches with parts of which shown as 79*a* and 79*b*. As can be seen in this FIGURE, trenches 79*a* and 79*b* are made within sacrificial layer 78, such that a surface of first structure layer 76 is exposed. The formation of closed trenches 79*a* and 79*b* cause the sacrificial layer 78 to be divided into two sections, including a center section 78*a*, and an outer section 78*b*. Thereafter, and as depicted in FIGS. 8*e* and 8*f*, a second structure layer 80 is deposited, which in some embodiments is a metal layer or a thin oxide or nitride layer. Second structure layer 80 includes a horizontal layer portion 80*a* and portions which fill in the closed trenches in the sacrificial layer and which are formed as closed, filled trenches or vertical sidewall structures. Parts of the closed, filled trenches or vertical sidewalls are shown in the FIGURE as 80*b* and 80*c*. By this design, end surfaces of filled trenches 80*b* and 80*c* come into contact with a surface of the first structure layer 76. FIG. 8*f* shows that holes 84*a* and 84*b* are formed in the second structure layer 80, where holes 84*a* and 84*b* are created such that sections of the surface for center sacrificial portion 78*a* are exposed. Holes 84*a* and 84*b* are positioned to act as fluid inlets in the formed fluid ejector.

Figure 8G:
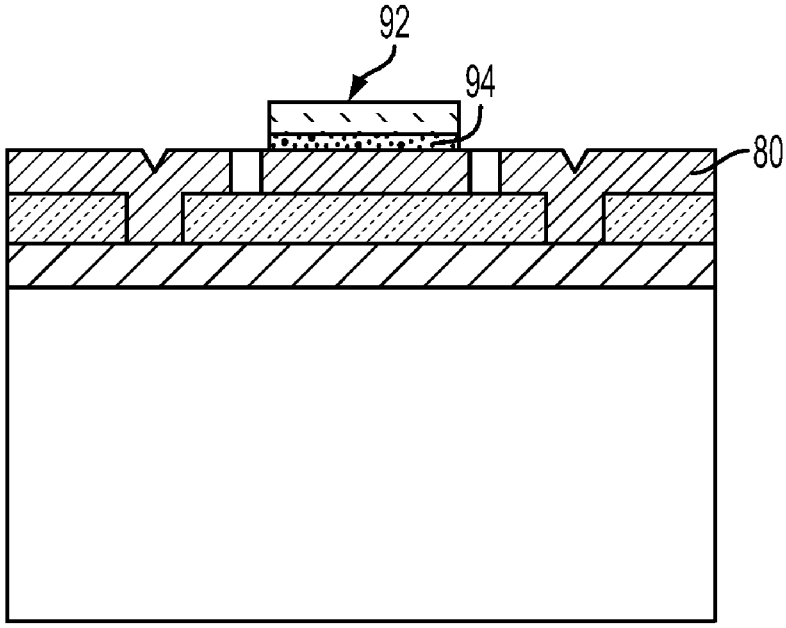

Next, in FIG. 8*g* a piezoelectric thin film 92 is shown bonded to a surface of the second structure layer 80 via bonding layer 94.

Figure 8H:
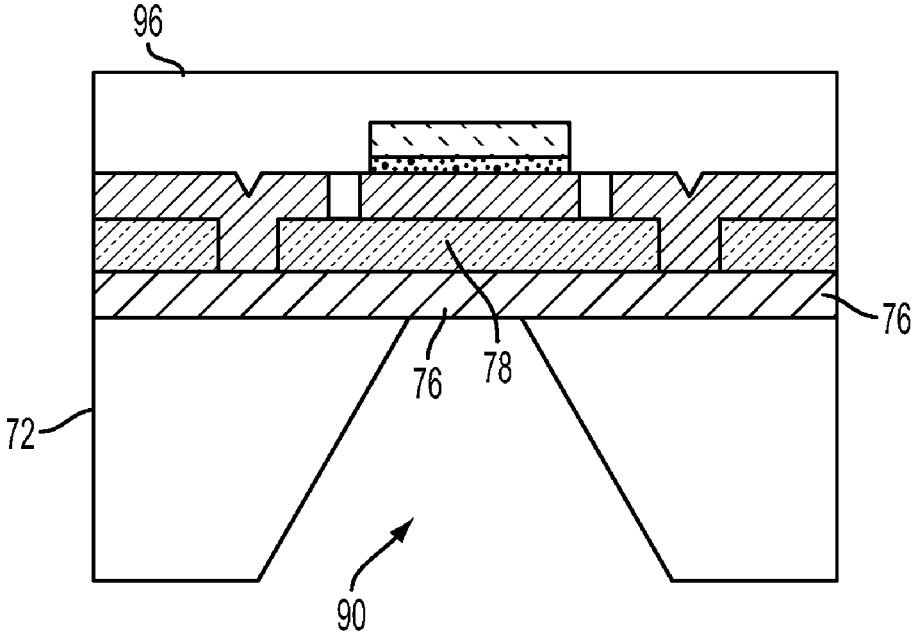

Turning to FIG. 8*h*, the side of the device with the piezoelectric is protected through the application of resist material and/or tape 96. It is desirable to protect the piezoelectric side of the device, as the next step in the process includes etching, drilling or otherwise removing portions of silicon wafer 72 to create opening 90.

Figure 8I:
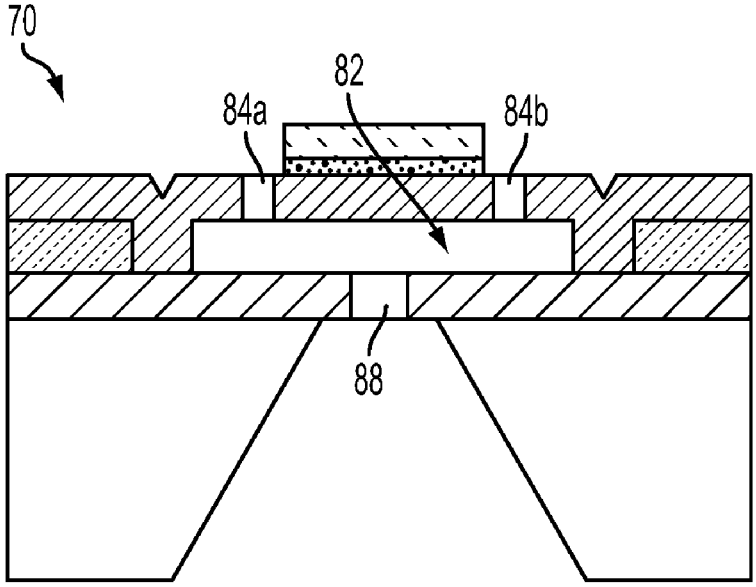

Opening 90 exposes a surface portion of the first structure layer 76, corresponding to at least a portion of the center sacrificial layer portion 78*a*. Thereafter, and as illustrated in FIG. 8*i*, aperture 88 is formed in first structure layer 76 by a laser drilling or etching step. Aperture 88 also works as an opening into the center sacrificial layer portion 78*a*, whereby etching for removal of the sacrificial material is undertaken. By this process, fluid cavity 82 is formed. Once these processes are complete, the protective layer 96 is removed. By removal of layer 96, holes or inlets 84*a* and 84*b* provide passages for fluid cavity 82, wherein fluid within fluid cavity 82 is ejected via aperture 88 from fluid ejector 70.

It is pointed out that in FIGS. 1 and 5 drive electronics are shown integrated with the silicon wafer. A similar arrangement may be provided in connection with the described fluid ejector 70 of FIG. 7. However, considering the cost issue providing integrated electronics may not be necessary for all cases. For example, if the nozzle density is very low, surface mounting the drive electronics (which are manufactured separately) may be more cost effective. When it is necessary to have integrated drive electronics a laser liftoff process can be used to transfer the piezoelectric elements. The laser transfer method may also be used to avoid the contamination problem. On the other hand, if the drive electronics are fabricated separately, the piezoelectric thin film can be directly deposited on the silicon wafer.

Figure 9:
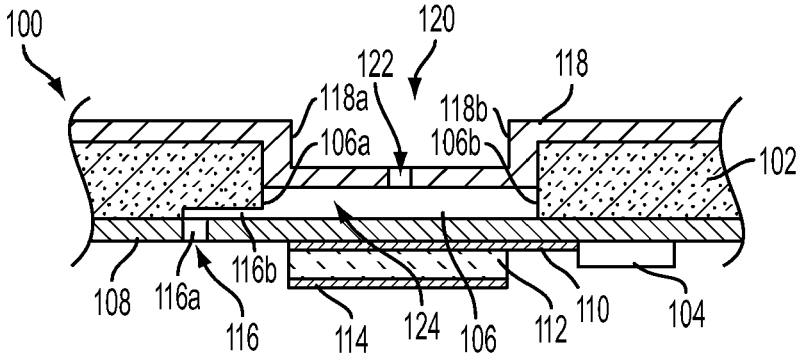
FIG. 9 shows a third embodiment for a structure of a micromachined fluid injector in accordance with the present application.

Turning to FIG. 9, illustrated is a fluid ejector 100, including a bulk silicon wafer 102 which has surface mounted drive electronics 104. The bulk silicon wafer is micromachined to form an open area 106 having sidewalls 106*a*, 106*b*. Deposited on a surface of silicon wafer 102 is a thin structure layer (or membrane) 108, preferably with a thickness of a few micrometers (e.g., 1 μm to 10 μm, and more preferably 1 μm to 3 μm thick). Thin structure layer 108 can be a silicon based material such as polysilicon, silicon nitride or oxide. In FIG. 9 thin structure layer 108 is a patterned silicon nitride or oxide, on which is a very thin metal layer 110 which acts as a bottom electrode of deposited and patterned piezoelectric 112. Bottom electrode 110 is also used to connect piezoelectric 112 to surface mounted drive electronics 104. A top electrode 114 is deposited on a second side of piezoelectric 112. The top electrode 114 can be connected to the drive electronics 104 by any well-known connection method, such as but not limited to, wire bonding (not shown in the FIGURE). Piezoelectric 112 and thin structure layer 108 forming a bending mode diaphragm actuator for pushing fluid. A fluid channel 116 is formed by micromachined or laser drilled opening 116*a* and micromachined channel 116*b*. Additional fluid channels may be formed as needed.

A separately fabricated nozzle plate 118 having vertical walls 118*a*, 118*b*, a recessed nozzle structure 120, and an aperture 122, is bonded and sealed to a second side of silicon wafer 102. Silicon sidewalls 106*a*, 106*b*, thin structure layer 108 and recessed portion 120 of nozzle plate 118 define a reduced volume fluid cavity 124 within the silicon wafer 102. The recessed portion 120 of nozzle plate 118 is fitted into open area 106 of silicon wafer 102 to form a top portion of fluid cavity 124. The depth of recess 120 acts to define the height (or depth) of fluid cavity 124, where the height (or depth) of fluid cavity 124 is less than the thickness of silicon wafer 102. In one embodiment, recess 120 is selected so the height (or depth) of fluid cavity 124 is about 200 μm or less (and more preferably in a range of 100 μm to 200 μm). Nozzle plate 118 can be made from metal such as nickel or other appropriate material.

While a single fluid ejector is shown, arrays of fluid ejectors, having the same or similar structure as shown in FIG. 9, can be made on a silicon wafer.

Turning to FIGS. 10*a*-10*f*, illustrated are the major steps used to make fluid ejector 100 of FIG. 9.

Figure 10A:
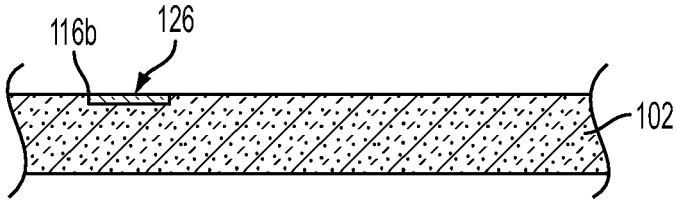
FIGS. 10*a*-10*f* depict a process flow for manufacturing the fluid injector of FIG. 9.

As depicted in FIG. 10*a*, starting with silicon wafer 102 having a first side and a second side, a thin and relatively long well or channel 116*b* (which will be part of fluid inlet 116) is etched on the first side and then filled with sacrificial material 126, such as PSG glass (phosphosilicate glass) or other etchable or removable material. Several wells will be made if several channels are to be used.

Figure 10B:
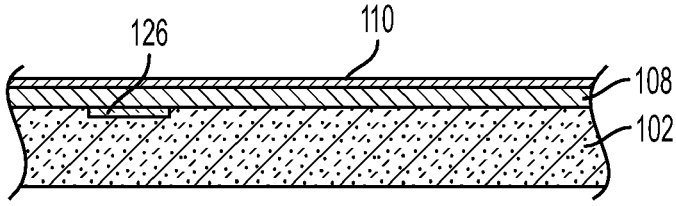

In FIG. 10*b*, thin structure layer 108, with a thickness of a few micrometers (e.g., 1 μm to 10 μm, and preferably 1 μm to 3 μm thick), is deposited onto a surface of silicon wafer 102 to covering sacrificial material 126. The material of thin structure layer 108 can be a silicon based material such as polysilicon, silicon nitride or oxide, so that selective etching can be made between the bulk silicon wafer and this membrane layer. Next, the bottom electrode 110 is deposited on a surface of structure layer 108. The bottom electrode 110 also works as a buffer layer to prevent a reaction between the piezoelectric film 110 and the silicon thin layer structure, and therefore an inert/noble metal material is preferred. A specific material which may be used is platinum (Pt). In order to enhance the adhesion between the bottom electrode and the silicon thin layer structure, commonly another thin metal layer, such as titanium (Ti), may be deposited between the silicon thin layer structure and the platinum (Pt) bottom electrode layer.

Figure 10C:
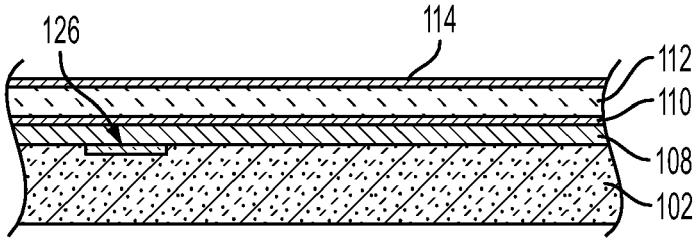

Turning to FIG. 10*c*, piezoelectric thin film 112 is shown deposited on bottom electrode 110. This depositing step includes but is not limited to using a deposition method such as sol-gel, sputtering, CVD (chemical vapor deposition), PLD (pulsed laser deposition), or other suitable deposition method. Next, top electrode 114 is deposited, and the piezoelectric thin film 112 is poled to generate the piezoelectric property.

Figure 10D:
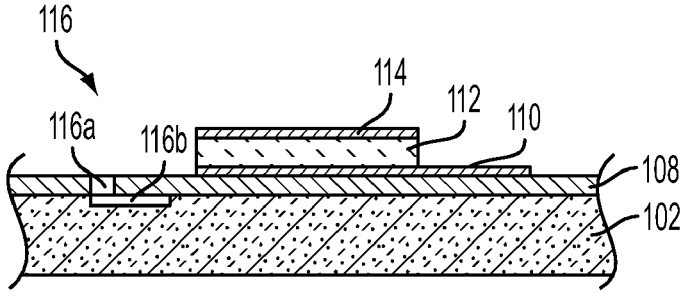
Figure 10E:
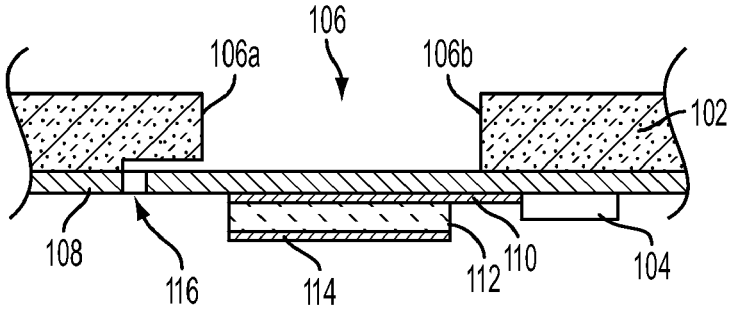

As shown in FIG. 10*d*, top electrode 114, piezoelectric 112 and bottom electrode 110 are patterned. Then hole 116*a* is etched or drilled in the thin structure layer 108, and sacrificial material 126 is etched away by use of hole 116*a*, in order to form ink inlet channel 116. Then, as illustrated in FIG. 10*e* (where the described structure has been rotated top-to-bottom from its presentation in FIG. 10*d*), the drive electronics 104 has been surface mounted to the first side of the silicon wafer and connected to the piezoelectric thin film 11. After that, on the second side of silicon wafer 102, micromachining of the silicon wafer is undertaken to selectively remove silicon and form opening area 106 having sidewalls 106*a*, 106*b*. Fluid cavity 124 is to be defined within open area 106.

Figure 10F:
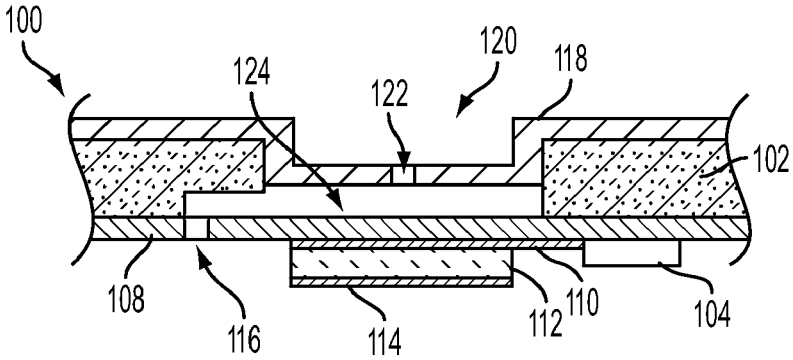

FIG. 10*f* shows nozzle plate 118 produced according to the required structure, i.e., including recessed portion 120 and aperture 122. Details on the manufacture of nozzle plate 118 have previously been provided in connection with FIGS. 3*a*-3*c* and 4*a*-4*c*.

As depicted in FIG. 10*f*, nozzle plate 118 is bonded to silicon wafer 102 to form fluid ejector 100 with selectably sizable fluid cavity 124. The nozzle plate 118 may be bonded with adhesive or solder which will fill in gaps to avoid air bubbles and seal the ink cavity.

In each of the foregoing embodiments, the manufacturing process may provide an appropriate thickness ratio between the piezoelectric layer and the structure layer (i.e., structure layer 18 of FIG. 1, and structure layer portion 80*a* of FIG. 7) to optimize the actuation performance.

Through controlling the variable features of (i) the thickness and materials of structural layer 18 (of FIG. 1), or center horizontal layer portion 80*a* (of FIG. 7), (ii) the piezoelectric thickness (20 of FIGS. 1 and 92 of FIG. 7), and (iii) the depth of the fluid cavity (32 of FIG. 1, 82 of FIG. 7) appropriate impedance matching may be selected to optimize the transfer of energy into the fluid cavity for fluid ejection.

It has been further considered by the inventors that a range of a piezoelectric layer of 1 μm to 10 μm (and more preferably in a range of 1 μm to 5 μm), in combination with a structure layer (18 in FIGS. 1 and 80 or 80*a* in FIG. 7) of 1 μm to 10 μm (and more preferably 1 μm to 3 μm) with a cavity depth of 200 μm or less (and more preferably 100 μm to 200 μm), will also provide desirable results.

The disclosures related to FIGS. 1 and 5, illustrate that a fluid ejector employing piezoelectric actuation can have the depth of the fluid cavity 32 adjusted to obtain a desirable mechanical impedance matching. More specifically, when the thickness of the piezoelectric and/or silicon layers are varied, the depth of the recess 28 may also be varied, either increasing or decreasing the depth of the fluid cavity to permit an optimized mechanical impedance matching for optimized transfer of energy from the piezoelectric actuator into the fluid cavity. Thus, it is to be understood the processes shown in FIGS. 3*a*-3*c* and 4*a*-4*c* are adjustable in order to provide nozzle plates having different recessed portions. As mentioned above, while a single fluid ejector for each of the embodiments in FIGS. 1, 5 and 7 have been depicted and discussed, a multitude or array of each of these fluid ejectors may be manufactured on a single piece of silicon wafer. In these embodiments, it is therefore possible to have in a single array fluid ejector cavities having different depths. For example, in the embodiment of FIG. 1, a depth of recess 28 for nozzle plate 26 may be adjusted during the manufacturing processes of FIGS. 3*a*-3*c* and/or 4*a*-4*c*, whereby the depth or height of the fluid cavity can be changed. Similarly, in the process according to FIG. 7, the depth or height of layer 78 may be made to provide distinct heights or depths in the corresponding fluid cavity.

Also, while the nozzle plate with the recessed portion has been described to be used with the piezoelectric actuation system, it is to be understood benefits may be obtained when a nozzle plate having a recessed profile as shown in the foregoing discussion is applied to other fluid ejectors such as those using electrostatic actuation. More particularly, even with the non-piezoelectric based actuation systems, impedance matching between actuators of whatever type, and the depth of the fluid cavity, may improve or optimize the mechanical impedance matching of a fluid ejector.

In consideration of the lower driving voltages needed for piezoelectric thin film actuation, the following discussion is provided. The inventors have studied an electrostatic membrane driving structure which has a polysilicon membrane that is about 1000 μm×120 μm×2 μm and the membrane air gap (the distance between the lower surface of the polysilicon membrane and the bottom electrode) is about 1 μm. It has been found that with about 100V driving voltage, the center point displacement of the membrane is about 0.25 μm. The membrane moves only along one direction, a downward movement.

The inventors have also calculated the center point displacement of a piezoelectric diaphragm actuator which has similar lateral dimensions as the electrostatic membrane actuator described above but the diaphragm or membrane is composed of 1 μm thick polysilicon and 2 μm thick sol-gel piezoelectric (e.g., PZT, lead zirconate titanate) thin film. The mechanical stiffness of 1 μm thick polysilicon and 2 μm thick sol-gel piezoelectric (e.g., PZT) thin film is about the same as that of 2 μm thick polysilicon, which means this arrangement can generate the same force if the same displacement is achieved. It has been calculated by the inventors that only 4V applied voltage can generate 0.173 μm center point displacement for the piezoelectric diaphragm actuator. Considering that a piezoelectric actuator can move in two directions (up and down), by applying ±4V it is possible to generate a 0.346 μm center point displacement. Thus it can be seen that to generate a similar displacement and force, the driving voltage can be significantly reduced by using piezoelectric actuation instead of electrostatic actuation.

The present disclosure thus describes a manner to easily change the fluid cavity size to realize the mechanical impedance matching between the fluid in the fluid cavity and the actuator. When using a thin film piezoelectric actuator or even an electrostatic membrane actuator, the fluid cavity needs to be relatively small, especially for the cavity height, which needs to be about 200 μm or less. As a conventional silicon wafer is about 300 μm thick or more, this makes it difficult to form a small ink cavity using the entire thickness of the silicon wafer body. However, by using a recessed nozzle plate to fit into the opening area made on the silicon wafer body, the fluid cavity height can easily be reduced to about 200 μm or less, without reducing the thickness of the silicon wafer. For the embodiment of FIGS. 7, 8*a*-8*i*, the fluid cavity height can be easily controlled during the manufacturing process.

Thus, the present application specifically shows a fluid ejector which permits the use of a nozzle plate which may change its shape, and in particular, the amount of recess in the nozzle plate, in order to adjust the fluid cavity volume. This adjustment is made in order to improve the performance of the ejector through improving the impedance matching between the fluid and the actuator.

The foregoing discussion sets forth the major processing steps for manufacturing various embodiments of the described fluid ejectors. Various minor processing steps, such as depositing electrodes and making certain electrical attachments, have not been specifically recited. These processing steps are well known in the art, and have not been specifically set forth, in some instances, simply to focus the application and to provide clarity in the drawings and discussion.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of forming a fluid ejector comprising:

forming a recess well into a bulk silicon wafer on a first side of the bulk silicon wafer;

filing in the recess well with a sacrificial material;

depositing a thin layer structure onto the first side of the bulk silicon wafer covering the filled in recess well;

bonding or depositing a thin film piezoelectric to the thin layer structure;

forming a hole in the thin layer structure exposing at least a portion of the sacrificial material;

removing the sacrificial material from the recess well, wherein the hole in the thin layer structure and the recess well with the removed sacrificial material, form a fluid inlet;

forming an opening area in the bulk silicon wafer, from a second side of the bulk silicon wafer;

forming a nozzle plate having a recessed portion and an aperture within the recessed portion; and attaching the nozzle plate to the second side of the bulk silicon wafer, with the recessed portion positioned within the opening area, the thin layer structure and the recessed portion of the nozzle plate defining a depth of a fluid cavity defined by the thin layer structure, the recessed portion of the nozzle plate and the sidewalls of the bulk silicon wafer.

2. The method according to claim 1, wherein drive electronics are one of integrated with the bulk silicon wafer or surface mounted on the bulk silicon wafer.

3. The method according to claim 1, wherein the step of forming the nozzle plate includes mechanically stamping the nozzle plate.

4. The method according to claim 1, wherein the step of forming the nozzle plate includes electroplating the nozzle plate.

5. The method according to claim 1, wherein prior to the step of bonding the thin film piezoelectric to the thin layer structure, further including fabricating the thin film piezoelectric on a substrate, wherein the substrate is other than the silicon wafer, and wherein following the bonding step, removing the substrate from the bonded thin film piezoelectric by a laser lift-off process.

6. The method according to claim 5, wherein the substrate removed by the laser liftoff process is a transparent substrate.

7. The method according to claim 5, wherein the bonding of the thin film piezoelectric to the thin structure layer includes using a thin film metal transient liquid phase bonding.

8. The method according to claim 1, further including integrating drive electronics on the silicon wafer.

9. The method according to claim 1, wherein the thin structure layer is one of polysilicon, silicon nitride, silicon oxide or metal.

10. The method according to claim 1, wherein the thin structure layer is deposited by a shadow mask or by dry or wet etching.

11. A method of forming a fluid ejector comprising:

forming a recess well into a silicon wafer on a first side of the silicon wafer;

filing in the recess well with a sacrificial material;

depositing a thin layer structure onto the first side of the bulk silicon wafer covering the filled in recess well;

bonding or depositing a thin film piezoelectric directly to the thin layer structure;

forming a hole in the thin layer structure exposing at least a portion of the sacrificial material;

removing the sacrificial material from the recess well, wherein the hole in the thin layer structure and the recess well with the removed sacrificial material, form a fluid inlet;

forming an opening area in the bulk silicon wafer, from a second side of the bulk silicon wafer;

forming a nozzle plate having a recessed portion and an aperture within the recessed portion;

attaching the nozzle plate to the second side of the bulk silicon wafer, with the recessed portion positioned within the opening area, the thin layer structure and the recessed portion of the nozzle plate defining a depth of a fluid cavity defined by the thin layer structure, the recessed portion of the nozzle plate and the sidewalls of the bulk silicon wafer.

12. The method according to claim 11, wherein drive electronics are one of integrated with the bulk silicon wafer or surface mounted on the bulk silicon wafer.

13. The method according to claim 11, wherein the step of forming the nozzle plate includes mechanically stamping the nozzle plate.

14. The method according to claim 11, wherein the step of forming the nozzle plate includes electroplating the nozzle plate.

15. The method according to claim 11, wherein prior to the step of bonding the thin film piezoelectric to the thin layer structure, further including fabricating the thin film piezoelectric on a substrate, wherein the substrate is other than the silicon wafer, and wherein following the bonding step, removing the substrate from the bonded thin film piezoelectric by a laser lift-off process.

16. The method according to claim 15, wherein the substrate removed by the laser liftoff process is a transparent substrate.

17. The method according to claim 15, wherein the bonding of the thin film piezoelectric to the thin structure layer includes using a thin film metal transient liquid phase bonding.

18. The method according to claim 11, further including integrating drive electronics on the silicon wafer.

19. The method according to claim 11, wherein the thin structure layer is one of polysilicon, silicon nitride, silicon oxide or metal.

20. The method according to claim 11, wherein the thin structure layer is deposited by a shadow mask or by dry or wet etching.

* * * * *